US006354089B1

(12) United States Patent
Lech et al.

(10) Patent No.: US 6,354,089 B1
(45) Date of Patent: Mar. 12, 2002

(54) APPARATUS AND METHOD FOR COOLING MULTIPLE FLUIDS ON A WORK VEHICLE

(75) Inventors: Richard J. Lech; Larry A. Johnson, both of Burlington, IA (US)

(73) Assignee: Case Corporation, Racine, WI (US)

( * ) Notice: Subject to any disclaimer, the term of this patent is extended or adjusted under 35 U.S.C. 154(b) by 0 days.

(21) Appl. No.: 09/520,464

(22) Filed: Mar. 8, 2000

(51) Int. Cl.[7] ..... F17C 3/00
(52) U.S. Cl. ..... 62/50.2
(58) Field of Search ..... 62/98, 50.2

(56) References Cited

U.S. PATENT DOCUMENTS

| | | | | |
|---|---|---|---|---|
| 4,633,938 A | | 1/1987 | Schunck et al. | 165/47 |
| 4,680,928 A | | 7/1987 | Nishikawa et al. | 60/329 |
| 6,024,164 A | * | 2/2000 | Sorbel | 165/41 |

* cited by examiner

*Primary Examiner*—William Doerrler
*Assistant Examiner*—Malik N. Drake

(74) *Attorney, Agent, or Firm*—Foley & Lardner

(57) ABSTRACT

A work vehicle is disclosed, the vehicle including first and second hydraulic circuits provided with first and second fluids, wherein the fluids are to be is kept apart; at least one fluid cooler for cooling at least one of the fluids; and a means for transferring heat from the hotter fluid to the cooler fluid. Also disclosed is a fluid cooling apparatus for a work vehicle, the work vehicle including a transmission with a first fluid and a hydraulic circuit with a second fluid. The cooling apparatus includes at least one fluid cooler for cooling at least one of the fluids, and an apparatus for transferring heat from the hotter fluid to the other fluid. Also disclosed is a method of cooling fluids of a work vehicle provided with a first hydraulic circuit including a first fluid and a second hydraulic circuit including a second fluid, the fluids to be kept separate. At least one of the hydraulic circuits includes a fluid cooler and a pump. The vehicle is further provided with a heat transfer apparatus for transferring heat from the hotter fluid to the other fluid. The method includes steps of pumping the first or second fluid through the fluid cooler, and pumping the first or second fluid through the heat transfer apparatus.

31 Claims, 2 Drawing Sheets

APPARATUS AND METHOD FOR COOLING MULTIPLE FLUIDS ON A WORK VEHICLE

FIELD OF THE INVENTION

The present invention relates generally to the field of work vehicles. It relates more particularly to a system for cooling of hydraulic fluids of a work vehicle.

BACKGROUND OF THE INVENTION

Work vehicles used in construction and agriculture often include two hydraulic circuits provided with different fluids. In many instances, the first hydraulic circuit is a transmission (e.g., an automatic transmission with a torque converter or a hydrostatic transmission) and the second hydraulic circuit is a tool hydraulic circuit; e.g., a system fluidly driving the buckets, linkages, boom, dipperstick, etc. of a tractor mounted backhoe/loader. The transmission has fluid characteristic needs differing from those of the tool hydraulic circuit, and there are therefore two separate fluid circuits, provided with differing fluids which should not be mixed, on the work vehicle.

In such work vehicles, each hydraulic circuit will usually have its own fluid cooler. Cooling system efficiencies must often be compromised due to lack of space on the work vehicle to place two separate coolers, each of capacity adequate for its hydraulic circuit. The coolers provided are therefore often of capacities which are marginal at best, and sometimes inadequate with heavy work loads in hot weather.

Again referring to the example of the backhoe-loader, the largest heat load generated in the tool hydraulic circuit occurs when the backhoe is worked very hard in high ambient temperatures. During this backhoe operation, the transmission heat load is very small. Conversely, the largest transmission heat loads occur during high-speed roading or during very heavy loader work involving dozing or other high push efforts. During this roading or loader work the tool hydraulic circuit is generally developing very little heat.

Another problem sometimes arises in frigid winter weather in some locations, related to cold, stiff, viscous fluid. Heat rejected at a fluid cooler could well be used to maintain the temperature of the fluid in the other circuit in order to improve wear life of that circuit's components and to improve overall efficiency of the work vehicle.

It would be advantageous to provide for a work vehicle having two, or more, hydraulic circuits with differing fluids to have a capability of transferring heat from whichever of the fluids is hotter to the other fluid. It would also be advantageous to provide for a work vehicle to have a cooling system fully adequate for all conditions of operation without increasing size of a fluid cooler. It would further be advantageous to provide for a work vehicle to maintain an unloaded hydraulic circuit at a working temperature during frigid weather.

SUMMARY OF THE INVENTION

One embodiment of the invention relates to a work vehicle including a vehicle structure, a power source supported by the vehicle structure, a plurality of wheels rotatably secured to the structure for supporting the structure upon a surface and rotatably coupled to the power source for moving the vehicle across the surface. The work vehicle also includes a first hydraulic circuit including a first fluid, the first fluid being heated by a first mechanical system of the work vehicle; and a second hydraulic circuit including a second fluid, the second fluid being heated by a second mechanical system of the work vehicle. The first and second hydraulic circuits are configured to maintain the second fluid separate from the first fluid. The work vehicle further includes at least one fluid cooler for cooling one of the first and second fluids; as well as an apparatus for transferring heat from the first fluid to the second fluid when the first fluid is hotter than the second fluid and for transferring heat from the second fluid to the first fluid when the second fluid is hotter than the first fluid.

Another embodiment of the invention relates to a fluid cooling apparatus for a work vehicle. The work vehicle includes a power source and a transmission for moving the vehicle across a surface. The transmission is provided with a transmission fluid. The work vehicle further includes a tool hydraulic circuit, the tool hydraulic circuit including a hydraulic fluid. One of the transmission fluid and the hydraulic fluid is operatively hotter than the other of the transmission fluid and the hydraulic fluid. The cooling apparatus includes at least one fluid cooler for cooling at least one of the transmission and the hydraulic fluids, and an apparatus for transferring heat from the hotter of the transmission and hydraulic fluids to the other of the transmission and hydraulic fluids.

Another embodiment of the invention relates to a method of cooling a plurality of fluids of a work vehicle provided with at least a first hydraulic circuit including a first fluid and a second hydraulic circuit including a second fluid. The first and second hydraulic circuits are configured to maintain the second fluid separate from the first fluid. One of the first and second fluids is hotter than the other of the first and second fluids. At least one of the first and the second hydraulic circuits further includes a fluid cooler for cooling the first or the second fluid respectively and a pump for circulating the first or the second fluid respectively through the fluid cooler. The vehicle is further provided with a heat transfer apparatus for transferring heat from the hotter of the first and the second fluids to the other of the first and the second fluids. The method includes the steps of using the pump to circulate the first or the second fluid through the fluid cooler, and using the pump to circulate the first or the second fluid through the heat transfer apparatus.

DETAILED DESCRIPTION OF THE PREFERRED EMBODIMENTS

Figure 1:
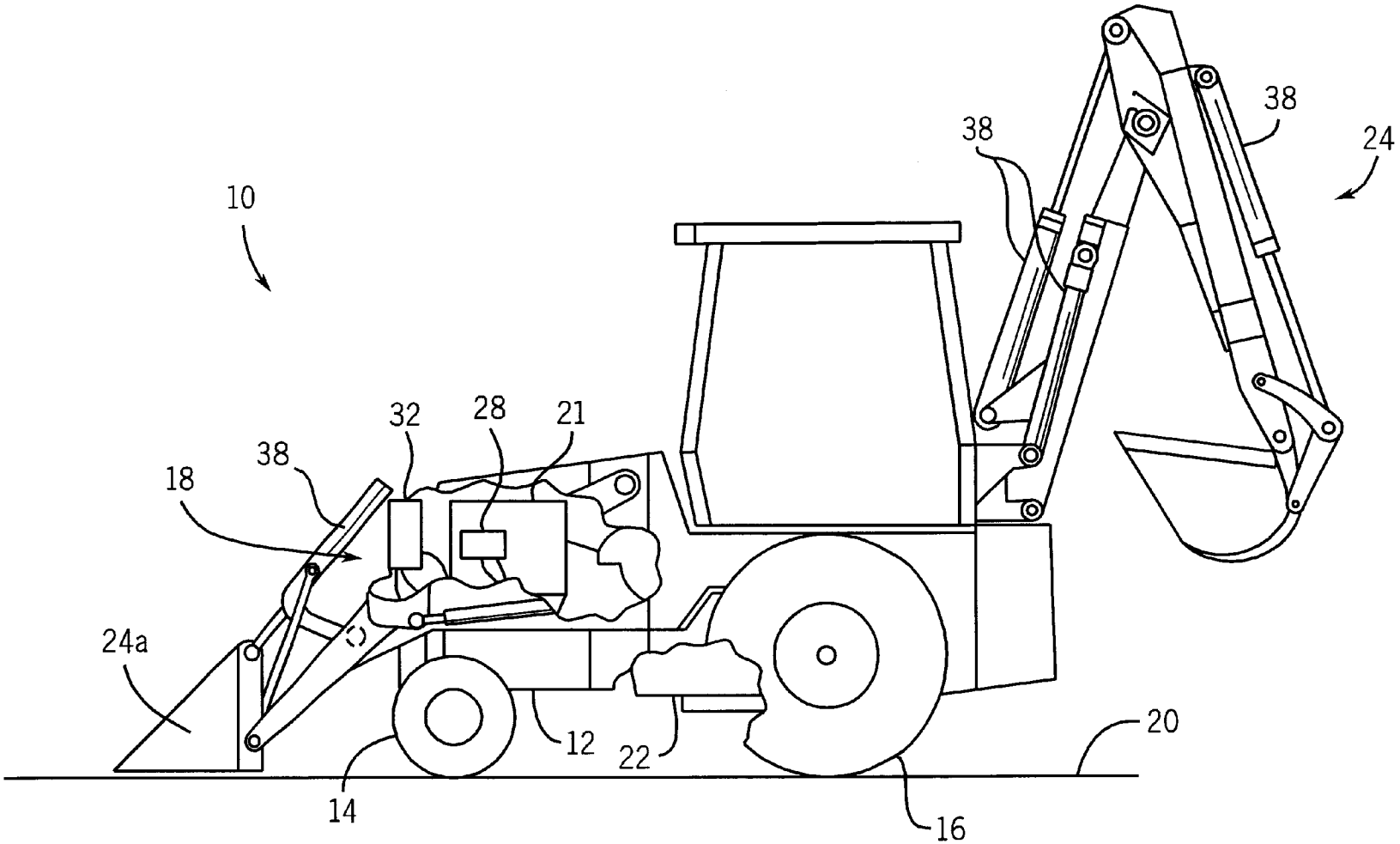
FIG. 1 is a side elevation of a work vehicle configured per an exemplary embodiment of the present fluid cooling circuit.

FIG. 1 shows a work vehicle 10 including a structure (shown as a frame 12), a plurality of wheels 14 including at least one drive wheel 16 for propelling vehicle 10 over a surface 20, a power source (shown as an engine 21), and a transmission 22 for coupling drive wheel 16 to engine 21. Work vehicle 10 also includes at least a first hydraulically actuated tool 24 (illustrated here as a loading bucket) and, in the illustrated instance, a second hydraulically actuated tool 24*a* (illustrated here as a backhoe). Work vehicle 10 further includes a first hydraulic circuit 26 (shown in FIG. 2) including a first pump 28, a first fluid 30, and a first fluid cooler 32 for powering the at least one tool 24, and a second hydraulic circuit 34, including a second fluid 36, for lubricating and cooling transmission 22 (and an associated torque converter, if included with transmission 22). First fluid 30 and second fluid 36 are formulated and produced to have differing properties, due to the differing needs of actuators 38 for tool 24 and of transmission 22. First fluid 30 and second fluid 36 must be kept separate from each other, and not allowed to contaminate each other by mixing.

While wheels 14, 16 are illustrated as rubber-tired wheels, they may be, in an alternative embodiment (not shown) idler and drive sprockets, respectively, of an endless track drive. The track may be fashioned of any of the conventional track and track shoe or cleat materials; e.g., steel, iron, elastomer, etc. Further, work vehicle 10 is illustrated as a rigid (i.e., not articulated) tractor having two powered wheels 16 and two unpowered wheels 14. An articulated tractor, or another configuration of work vehicle, or a work vehicle having any number of powered and/or unpowered wheels, is, however, equally within the scope and spirit of the appended claims.

First pump 28, and any second hydraulic pump 40 (shown in FIG. 2) which may be present upon work vehicle 10, are generally coupled to and driven by engine 21. First fluid cooler 32, and any second fluid cooler 78 (shown in FIG. 3) which may be present, are generally placed in front of an engine cooling radiator (not shown) of work vehicle 10 in order to have an unimpeded flow of ambient air not preheated by the radiator. Fluid coolers 32, 78 are generally configured similar to a "radiator", being a liquid-to-air cooler utilizing forced convection (and only negligible amounts of thermal radiation) to reject heat to the ambient air. Fluid coolers may be located elsewhere on work vehicle 10, but other locations are generally impractical due to a likelihood of mechanical damage or fouling in the working environment of work vehicle 10, and to a desire not to direct the rejected heat toward an operator of work vehicle 10.

The frontal portion 18 of work vehicle 10 is easily designed and manufactured to accommodate a radiator of sufficient, even generous, size to cool engine 21, but it is more difficult, if possible at all, to allow sufficient space for one or more fluid coolers sufficient to cool both first fluid 30 and second fluid 36. This is because full engine power is often absorbed in transmission 22, and transferred to second fluid 36, during relatively high-speed road travel or during dozing operations, while little or no power is being expended at tool 24, and hence little or no heat is generated and transferred to first fluid 30. Conversely, at other times full engine power is absorbed at tool 24 and transferred to first fluid 30, while little or no power is expended at transmission 22 and hence little or no heat is generated and transferred to second fluid 36.

While there may be sufficient space for one fluid cooler to reject heat from dissipation of full engine power contained in one flow of hydraulic fluid, there is generally not sufficient space for two such fluid coolers upon work vehicle 10. That being the case, an exemplary embodiment includes at least one heat exchange device to transfer heat from the hotter of first fluid 30 and second fluid 36 to the other of first fluid 30 and second fluid 36. The heat may then be dissipated by a larger first cooler 32, or by a first cooler 32 and a second cooler 78 whose combined sizes and capacities are comparable to that of a larger first cooler 32.

Figure 2:
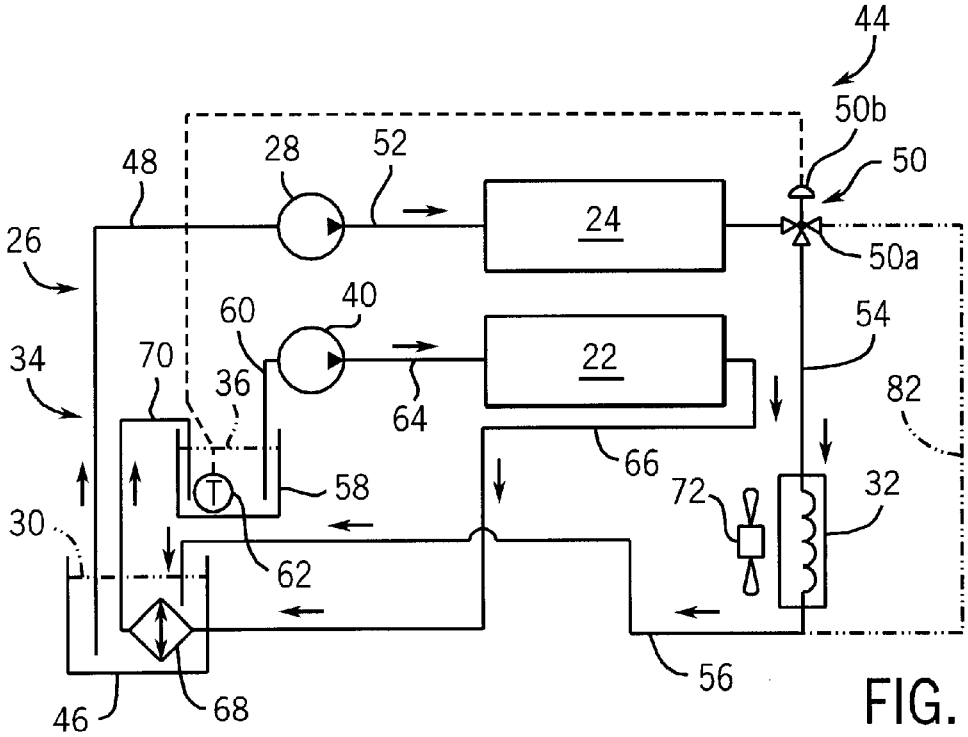
FIG. 2 is a schematic diagram of a hydraulic circuit of the work vehicle shown in FIG. 1

FIG. 2 shows a preferred embodiment of first hydraulic circuit 26 and second hydraulic circuit 34, integrated into a combined circuit 44. Combined circuit 44 shares heat between first circuit 26 and second circuit 34, but maintains second fluid 36 separate from first fluid 30. Combined circuit 44 includes a first reservoir 46 containing first fluid 30, a first suction conduit 48, first pump 28, a first pressure conduit 52 for delivering first fluid 30 to a first mechanical system (shown in FIG. 1 as first tool 24 and second tool 24*a*), a first fluid cooler return conduit 54, first fluid cooler 32, and a first tank return conduit 56. Combined circuit 44 also includes a second reservoir 58 containing second fluid 36, a second suction conduit 60, a second pump 40, a second pressure conduit 64 for delivering second fluid 36 to a second mechanical system (shown as transmission 22 in FIG. 1), a second coil return conduit 66 for delivering second fluid 36 to a tube bundle or coil 68, and a second tank return conduit 70.

Coil 68, within which second fluid 36 is circulated, is submerged within first fluid 30 within first reservoir 46. Coil 68 is constructed of a thermally conductive tubing material (e.g., copper or another metal), and heat is therefore convected from the hotter of first fluid 30 or second fluid 36 to an outer surface or inner surface, respectively, of coil 68, conducted through the wall of coil 68, and convected to the cooler of first fluid 30 or second fluid 36 from an outer or inner surface, respectively, of coil 68. Coil 68 therefore cooperates with first reservoir 46 to comprise a liquid-to-liquid heat transfer device. A fan 72 shown adjacent first fluid cooler 32 is typically an existing radiator cooling fan, coupled to engine 21.

In another exemplary embodiment, combined circuit 44 includes a control valve 50 and a cooler bypass conduit 82. Control valve 50 is disposed in the path of first fluid 30 downstream of first mechanical system 24, and in the illustrated instance includes a three-way valve body 50*a* coupled to an actuator 50*b*. Actuator 50*b* is operatively coupled (e.g., by electrical signal wires or a capillary tube) to a temperature sensing device 62, which is preferably immersed within second fluid 36 in second reservoir 58.

Temperature sensing device 62 and valve actuator 50*b* are selected to cause flow of first fluid 30 to bypass cooler 32 through a bypass conduit 82 (shown in phantom) when second fluid 36 is colder than desired; e.g., in frigid winter weather after work vehicle 10 has stood in one position for an extended length of time and second fluid 36 has become cold and excessively viscous. Those of skill in the art will readily discern the modifications necessary in placement of control valve 50 and temperature sensing device 62 in order to instead utilize heat within second fluid 36 to warm first fluid 30, or to either one of first fluid 30 and second fluid 36 to warm the other of first fluid 30 and second fluid 36.

Figure 3:
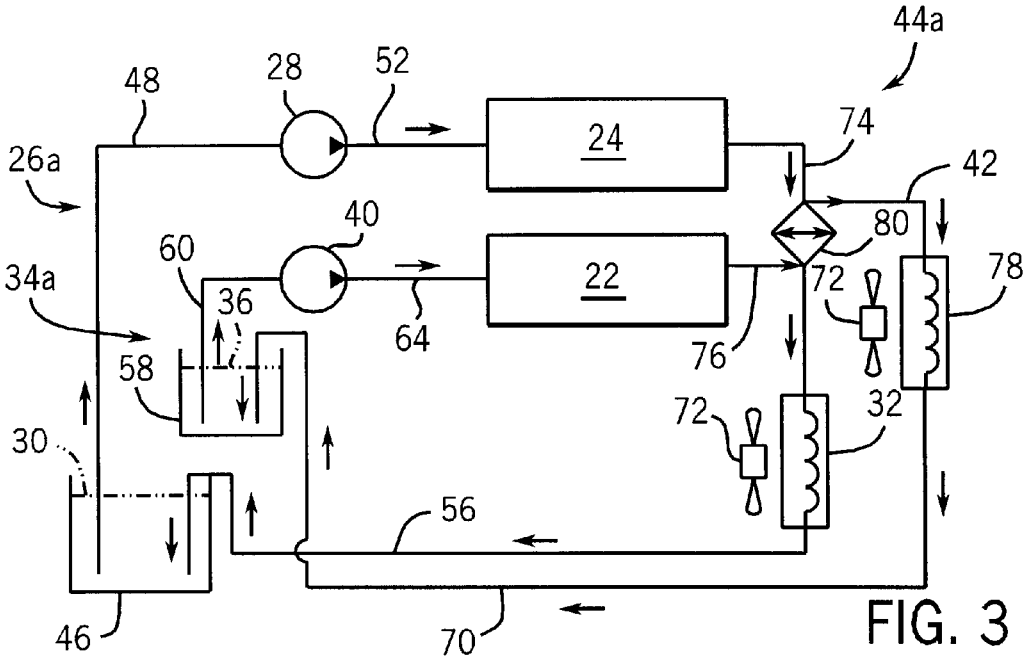
FIG. 3 is a schematic diagram of an alternative embodiment of a fluid cooling circuit.

FIG. 3 shows an alternative embodiment, wherein a first hydraulic circuit 26*a* and a second hydraulic circuit 34*a* are integrated into a combined hydraulic circuit 44*a* . First hydraulic circuit 26*a* includes a first reservoir 46 containing first fluid 30, a first suction conduit 48, a first pump 28, a first pressure conduit 52 delivering first fluid 30 to a first mechanical system (illustrated in FIG. 1 as a first tool 24 and a second tool 24), a first heat exchanger return conduit 74, a first fluid cooler return conduit 54, a first fluid cooler 32, and first tank return conduit 56. Second hydraulic circuit 34*a* includes a second reservoir 58, a second suction conduit 60, a second pump 40, a second pressure conduit 64 delivering second fluid to a second mechanical system (illustrated as transmission 22 in FIG. 1), a second heat exchanger return conduit 76, a second fluid cooler return conduit 42, a second fluid cooler 78, and a second tank return conduit 70.

Work vehicle 10*a* also includes a liquid-to-liquid heat exchanger 80; e.g., a shell-and-tube heat exchanger or a laminated plate (also known as plate-and-frame) heat exchanger. First fluid 30 flows through a first passage network (not shown) within heat exchanger 80, and second fluid 36 flows through a second passage network (not shown) within heat exchanger 80. Heat exchanger 80 is configured to maintain second fluid 36 separate and sealed from first fluid 30, while allowing heat to be transferred through tube walls or plate walls as described above for the tube walls of coil 68.

Combined circuit 44*a* is depicted with two fluid coolers (first fluid cooler 32 and second fluid cooler 78), but either combined circuit 44 or combined circuit 44*a* may be provided with one fluid cooler 32 as shown in FIG. 2 or a first fluid cooler 32 and a second fluid cooler 78 as shown in FIG. 3. Similarly, one or more temperature control valves 50, each provided with a temperature sensing device 62, may be added with bypass loops 82 (shown in FIG. 2) for preheating of a cold first fluid 30 or second fluid 36 as described above in reference to a preceding exemplary embodiment.

Thus, whether heat is being generated in a transmission 22 or in a hydraulically powered tool 24, the heat may be transferred as needed and dissipated in a larger first fluid cooler 32 or in a smaller first fluid cooler 32 and second fluid cooler 78.

The foregoing embodiments are to be viewed as exemplary, and not limiting. Many other variations will be apparent to those of skill in the art, but such variations are regarded as modifications of construction and not inventive. For example, a similar arrangement may be devised for a work vehicle having three, or more, differing fluids. The first and second pumps may be sections of a multiple pump. The heat exchanger may be integrated with one or both of the fluid coolers. All such variations of construction will be construed as falling within the scope and spirit of the appended claims.

What is claimed is:

1. A work vehicle comprising:

a vehicle structure;

a power source supported by the vehicle structure;

a plurality of wheels rotatably secured to the structure for supporting the structure upon a surface and rotatably coupled to the power source for moving the vehicle across the surface;

a first hydraulic circuit including a first fluid, the first fluid being heated by a first mechanical system of the work vehicle;

a second hydraulic circuit including a second fluid, the second fluid being heated by a second mechanical system of the work vehicle, wherein the first and second hydraulic circuits are configured to maintain the second fluid separate from the first fluid;

at least one fluid cooler for cooling one of the first and second fluids; and an apparatus for transferring heat from the first fluid to the second fluid when the first fluid is hotter than the second fluid and for transferring heat from the second fluid to the first fluid when the second fluid is hotter than the first fluid.

2. The work vehicle of claim 1, wherein the apparatus for transferring heat includes a fluid-to-fluid heat exchanger.

3. The work vehicle of claim 2, wherein the heat exchanger is configured as a shell-and-tube heat exchanger.

4. The work vehicle of claim 2, wherein the heat exchanger is configured as a laminated plate heat exchanger.

5. The work vehicle of claim 1, wherein the first hydraulic circuit includes a first fluid reservoir and the second hydraulic circuit includes a fluid conduit submerged in the first fluid within the first fluid reservoir and through which the second fluid is circulated, the conduit having a passage therethrough defined by a wall, the material of the wall having a thermal conductance, heat being thereby transferred between the first fluid and the second fluid.

6. The work vehicle of claim 1, wherein the work vehicle further comprises a transmission disposed in the path of power between the engine and the drive wheel, and further wherein the first mechanical system includes a hydraulic tool fluidly actuated by the first fluid and the second mechanical system includes the transmission of the work vehicle, the transmission being lubricated and cooled by the second fluid.

7. The work vehicle of claim 6, further including a fluid flow control device for bypassing the fluid cooler with the hotter of the first fluid and the second fluid when it is desired to warm the other of the first and second fluids.

8. The work vehicle of claim 7, wherein the fluid flow control device is a temperature control valve provided with a valve body assembly, a valve actuator, and a temperature sensor, wherein the valve actuator is coupled to the valve body assembly, the valve body includes a port for receiving the first fluid from an outlet of the actuator of the hydraulic tool, a second port for selectably delivering the first fluid to an inlet of the fluid cooler, and a third port for selectably delivering the first fluid to the first fluid reservoir while bypassing the fluid cooler, and further wherein the temperature control valve actuator is operatively coupled to the temperature sensor and the temperature sensor is positioned to sense the temperature of the second fluid.

9. The work vehicle of claim 1, further including a second fluid cooler for cooling the other of the first and second fluids.

10. A fluid cooling apparatus for a work vehicle, the work vehicle including a power source and a transmission for moving the vehicle across a surface, the transmission provided with a transmission fluid, the work vehicle further including a tool hydraulic circuit, the tool hydraulic circuit including a hydraulic fluid, one of the transmission fluid and the hydraulic fluid being operatively hotter than the other of the transmission fluid and the hydraulic fluid, the cooling apparatus comprising:

at least one fluid cooler for cooling at least one of the transmission and the hydraulic fluids; and an apparatus for transferring heat from the hotter of the transmission and hydraulic fluids to the other of the transmission and hydraulic fluids.

11. The fluid cooling apparatus of claim 10, wherein the apparatus for transferring heat is a fluid-to-fluid heat exchanger.

12. The fluid cooling apparatus of claim 11, wherein the heat exchanger is configured as a shell-and-tube heat exchanger.

13. The fluid cooling apparatus of claim 11, wherein the heat exchanger is configured as a laminated plate heat exchanger.

14. The fluid cooling apparatus of claim 11, wherein at least one of the transmission and tool hydraulic circuits includes a fluid reservoir, and the other of the transmission and tool hydraulic circuits includes a fluid conduit submerged in the fluid within the fluid reservoir and through which the fluid of the other of the transmission and hydraulic circuits is circulated, the conduit having a passage therethrough defined by a wall, the material of the wall having a thermal conductance, heat being thereby transferred between the transmission fluid and the tool hydraulic fluid.

15. The fluid cooling apparatus of claim 10, further including a second fluid cooler for cooling the other of the transmission and the hydraulic fluids.

16. A method of cooling a plurality of fluids of a work vehicle provided with at least a first hydraulic circuit including a first fluid and a second hydraulic circuit including a second fluid, the first and second hydraulic circuits being configured to maintain the second fluid separate from the first fluid, one of the first and second fluids being hotter than the other of the first and second fluids, at least one of the first and the second hydraulic circuits further including a fluid cooler for cooling the first or the second fluid respectively and a pump for circulating the first or the second fluid respectively through the fluid cooler, the vehicle further provided with a heat transfer apparatus for transferring heat from the hotter of the first and the second fluids to the other of the first and the second fluids, wherein at least one of the first and second hydraulic circuits includes a fluid reservoir containing a portion of the first or the second fluid respectively and the other of the first and second hydraulic circuits includes a conduit for containing and circulating the other of the first and second fluids and having a thermally conductive wall having an outer surface in thermally convective communication with the first or the second fluid within the reservoir and an inner surface in thermally convective communication with the other of the first and second fluids contained within the conduit, and further wherein a portion of the conduit is at least partially submerged within the first or second fluid disposed within the reservoir, the reservoir and the conduit comprising the apparatus for transferring heat, the method including the steps of:

a. using the pump to circulate the first or the second fluid through the fluid cooler;

b. using the pump to circulate the first or the second fluid through the heat transfer apparatus; and c. circulating the first or second fluid within the conduit through the conduit, thereby transferring heat from the first or the second fluid to the other of the first and the second fluids.

17. A method of cooling a plurality of fluids of a work vehicle provided with at least a first hydraulic circuit including a first fluid and a second hydraulic circuit including a second fluid, the first and second hydraulic circuits being configured to maintain the second fluid separate from the first fluid, one of the first and second fluids being hotter than the other of the first and second fluids, at least one of the first and the second hydraulic circuits further including a fluid cooler for cooling the first or the second fluid respectively and a pump for circulating the first or the second fluid respectively through the fluid cooler, the vehicle further provided with a heat transfer apparatus for transferring heat from the hotter of the first and the second fluids to the other of the first and the second fluids, wherein the heat transfer apparatus includes a liquid-to-liquid heat exchanger, and further wherein the pump is a first pump associated with the first hydraulic circuit and the second hydraulic circuit includes a second pump, comprising the steps of:

a. using the pump to circulate the first or the second fluid through the fluid cooler;

b. using the pump to circulate the first or the second fluid through the heat transfer apparatus;

c. circulating one of the first and second fluids through a first passage of the heat exchanger and through the fluid cooler; and d. circulating the other of the first and second fluids through a second passage of the heat exchanger.

18. The method of claim 17, wherein the pump is a first pump and the fluid cooler is a first fluid cooler, and further wherein the other of the first and second hydraulic circuits includes a second pump and a second fluid cooler, and further including the step of:

d. using the second pump to circulate the second fluid through the reservoir.

19. The method of claim 17, wherein the fluid cooler is a first fluid cooler and the other of the first and second hydraulic circuits further includes a second fluid cooler, and further including the step of:

e) using the second pump to circulate the other of the first and second fluids through the second fluid cooler.

20. A method of cooling a plurality of fluids of a work vehicle provided with at least a first hydraulic circuit including a first fluid and a second hydraulic circuit including a second fluid, the first and second hydraulic circuits being configured to maintain the second fluid separate from the first fluid, one of the first and second fluids being hotter than the other of the first and second fluids, at least one of the first and the second hydraulic circuits further including a fluid cooler for cooling the first or the second fluid respectively and a pump for circulating the first or the second fluid respectively through the fluid cooler, the vehicle further provided with a heat transfer apparatus for transferring heat from the hotter of the first and the second fluids to the other of the first and the second fluids, wherein at least one of the first and second hydraulic circuits further includes a control valve, comprising the steps of:

a. using the pump to circulate the first or the second fluid through the fluid cooler;

b. using the pump to circulate the first or the second fluid through the heat transfer apparatus; and c. modulating the control valve to bypass flow of the hotter of the first and second fluids around the fluid cooler when the other of the first and second fluids is of a lesser temperature than is desired, and thereby using the hotter fluid to heat the colder fluid.

21. The method of claim 20, wherein the step of modulating the control valve is performed automatically and in correspondence to the temperature of the colder of the first and second fluids.

22. A cooling system for a work vehicle, comprising:

a first hydraulic circuit including a first fluid, the first fluid being heated by a first mechanical system of the work vehicle;

a second hydraulic circuit including a second fluid, the second fluid being heated by a second mechanical system of the work vehicle; and a heat transfer apparatus configured to transfer heat from the first fluid to the second fluid when the first fluid is hotter than the second fluid, to transfer heat from the second fluid to the first fluid when the second fluid is hotter than the first fluid, and to maintain the first fluid separate from the second fluid.

23. The cooling system of claim 22, wherein the cooling system includes at least one fluid cooler for cooling one of the first and second fluids.

24. The cooling system of claim 22, wherein the heat transfer apparatus is a fluid to fluid heat exchanger.

25. The cooling system of claim 24, wherein the heat transfer apparatus is configured as a shell and tube heat exchanger.

26. The cooling system of claim 24, where the heat transfer apparatus is configured as a laminated plate heat exchanger.

27. The cooling system of claim 22, wherein the first hydraulic circuit includes a first fluid reservoir and the second hydraulic circuit includes a fluid conduit submerged in the first fluid within the first fluid reservoir and through which the second fluid is circulated, the conduit having a passage therethrough defined by a wall, the material of the wall having a thermal conductance, heat being thereby transferred between the first fluid and the second fluid.

28. The cooling system of claim 22, wherein the first mechanical system includes a hydraulic tool fluidly actuated by the first fluid and the second mechanical system includes the transmission of the work vehicle, the transmission being lubricated and cooled by the second fluid.

29. The cooling system of claim 28, further including a fluid flow control device for bypassing the fluid cooler with the hotter of the first fluid and the second fluid when it is desired to warm the other of the first and second fluids.

30. The cooling system of claim 29, wherein the fluid flow control device is a temperature control valve provided with a valve body assembly, a valve actuator, and a temperature sensor, wherein the valve actuator is coupled to the valve body assembly, the valve body includes a port for receiving the first fluid from an outlet of the actuator of the hydraulic tool, a second port for selectably delivering the first fluid to an inlet of the fluid cooler, and a third port for selectably delivering the first fluid to the first fluid reservoir while bypassing the fluid cooler, and further wherein the temperature control valve actuator is operatively coupled to the temperature sensor and the temperature sensor is positioned to sense the temperature of the second fluid.

31. The cooling system of claim 22, further including a second fluid cooler for cooling the other of the first and second fluids.

* * * * *